US006138855A

United States Patent [19]

Kopf

[11] Patent Number: 6,138,855

[45] Date of Patent: Oct. 31, 2000

[54] LID LIFTING APPARATUS FOR REFUSE CONTAINER

[76] Inventor: Bernard Kopf, 15 Farewell, Fairbanks, Ak. 99707

[21] Appl. No.: 09/465,500

[22] Filed: Dec. 16, 1999

[51] Int. Cl.[7] ..... B65D 43/26

[52] U.S. Cl. ..... 220/263; 220/826; 220/832; 220/908

[58] Field of Search ..... 220/263, 264, 220/826, 831, 832, 908

[56] References Cited

U.S. PATENT DOCUMENTS

| | | | |
|---|---|---|---|
| 1,236,429 | 8/1917 | Hansen | 220/263 |
| 1,308,563 | 7/1919 | Underwood et al. | 220/263 |
| 1,503,926 | 8/1924 | Staubli | 220/263 |
| 2,128,968 | 9/1938 | Scholl | 220/263 X |
| 4,119,240 | 10/1978 | Dumas et al. . | |
| 4,697,380 | 10/1987 | Fenske . | |
| 4,892,218 | 1/1990 | Reiling . | |
| 5,011,036 | 4/1991 | Souza et al. . | |
| 5,248,057 | 9/1993 | Taylor | 220/263 X |
| 5,257,638 | 11/1993 | Alvemarker . | |
| 5,573,085 | 11/1996 | Galeazzi et al. . | |
| 5,910,006 | 6/1999 | Conroy et al. . | |

*Primary Examiner*—Stephen K. Cronin
*Attorney, Agent, or Firm*—Jeffrey L. Thompson; Thompson & Thompson P.A.

[57] ABSTRACT

An apparatus for lifting the lid of a refuse container comprises a handle arm having first and second ends with a handle pivotally coupled to the first end. The lifting apparatus further includes a lifting arm having a first end coupled to the second end of the handle arm. The lifting arm is pivotally attached to an end wall of a refuse bin, the bin having a generally rectangular body with a bottom, front and rear walls, opposing end walls, and a lid pivotally attached to an upper edge of the rear wall. The lifting arm is offset from and normal to the handle arm such that an operation of the handle arm rotates the lifting arm between a first horizontal position beneath the lid of the refuse container in a closed configuration and a second vertical position supporting the lid in an open configuration. A free end of the lifting arm is slidable between a position adjacent a forward edge of the lid in the first position and a position rearwardly displaced from the forward edge in the second position.

19 Claims, 5 Drawing Sheets

LID LIFTING APPARATUS FOR REFUSE CONTAINER

BACKGROUND OF THE INVENTION

This invention relates generally to front loading refuse containers and, more particularly, to an apparatus for selectably opening or closing a lid pivotally mounted to the refuse container.

Heavy refuse containers mounted on wheels and configured to be lifted by large refuse trucks are widely used by apartment complexes and commercial businesses. These refuse containers typically include a large bin with one or more heavy lids pivotally coupled to the top edge of a rear wall. A common difficulty frequently encountered by users of these refuse containers is raising and holding a lid while depositing refuse into the bin. This difficulty is magnified where multiple items need to be deposited or where both hands are needed in order to deposit large items into the bin.

Various devices have been proposed in the art for raising the lid of a refuse container. While U.S. Pat. Nos. 4,892,218 and 5,011,036 disclose the use of foot pedal devices for lifting a refuse container lid, no mechanism is shown for holding or locking the lid in an open position during deposit of material into the bin. Further, existing devices do not provide a leveraged configuration for easy manipulation of the lid.

Therefore, it is desirable to have an apparatus for lifting a lid of a refuse container which can selectively hold the lid in an open position while depositing refuse therein. It is further desirable to have a lifting apparatus which uses a leveraged configuration for easy manipulation of the lid.

SUMMARY OF THE INVENTION

According to the present invention, a lid lifting apparatus is attached to a refuse container. The refuse container is of the type which includes a large generally rectangular bin having a bottom, front and rear walls, opposing end walls, and at least one lid pivotally attached to an upper edge of the rear wall. The lifting apparatus includes first and second spaced apart mounting brackets attached to the upper edge of an end wall of the refuse container bin. Each bracket includes a leg extending outwardly from the upper edge of the end wall. A sleeve having a bore therethrough is mounted atop the extended leg of the first bracket.

The lifting apparatus further includes an elongate handle arm having a handle pivotally coupled to a first end thereof. An elongate lifting arm includes a first end fixedly attached to a second end of the handle arm. A portion of the lifting arm extends through the sleeve such that the lifting arm is offset from and normal to the handle arm. The lifting arm is pivotal within the sleeve.

A retaining flange extends upwardly from the free end of the extended leg thereof. The handle arm includes a first portion hingedly coupled to a second portion. In a first position, the handle arm extends downwardly along the end wall and the lifting arm extends horizontally beneath the closed lid of the refuse container, a free end of the lifting arm being adjacent a front edge of the lid. As a user pulls the handle of the handle arm forward, the lifting arm, pivoting within the sleeve, moves upward and rearward. The free end of the lifting arm slides rearward along the bottom surface of the lid as the handle arm is moved toward a horizontal position. The first portion of the handle arm may be pivoted outwardly to avoid contact with the extension arm of the second bracket and then pivoted inwardly to allow the handle arm to rest atop the second bracket. In this second position, the lifting arm is vertical for holding the lid in an open configuration. Alternatively, the lifting apparatus may include a ratchet assembly for incrementally opening or closing the lid.

Therefore, it is a general object of this invention to provide an apparatus which can selectively raise or lower the lid of a front-end loaded refuse container.

Another object of this invention is to provide an apparatus, as aforesaid, that is hand operated.

Still another object of this invention is to provide an apparatus, as aforesaid, utilizing a handle arm normal to a lifting arm for pivotally raising the lifting arm beneath the lid.

Yet another object of this invention is to provide an apparatus, as aforesaid, having a support bracket upon which the handle arm is supported when the lifting arm is in the vertical or open position.

A further object of this invention is to provide an apparatus, as aforesaid, wherein the handle arm is pivotal about the support bracket during an operation of the handle arm.

A still further object of this invention is to provide an apparatus, as aforesaid, wherein the lifting arm includes a roller for contacting the bottom surface of the lid while raising the lid.

Another object of this invention is to provide an apparatus, as aforesaid, which can incrementally raise or lower the lid and hold the lid at a desired position.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

The preferred embodiment of the lifting apparatus will now be described with reference to FIGS. 1–3 and 5 of the accompanying drawings.

Figure 1:
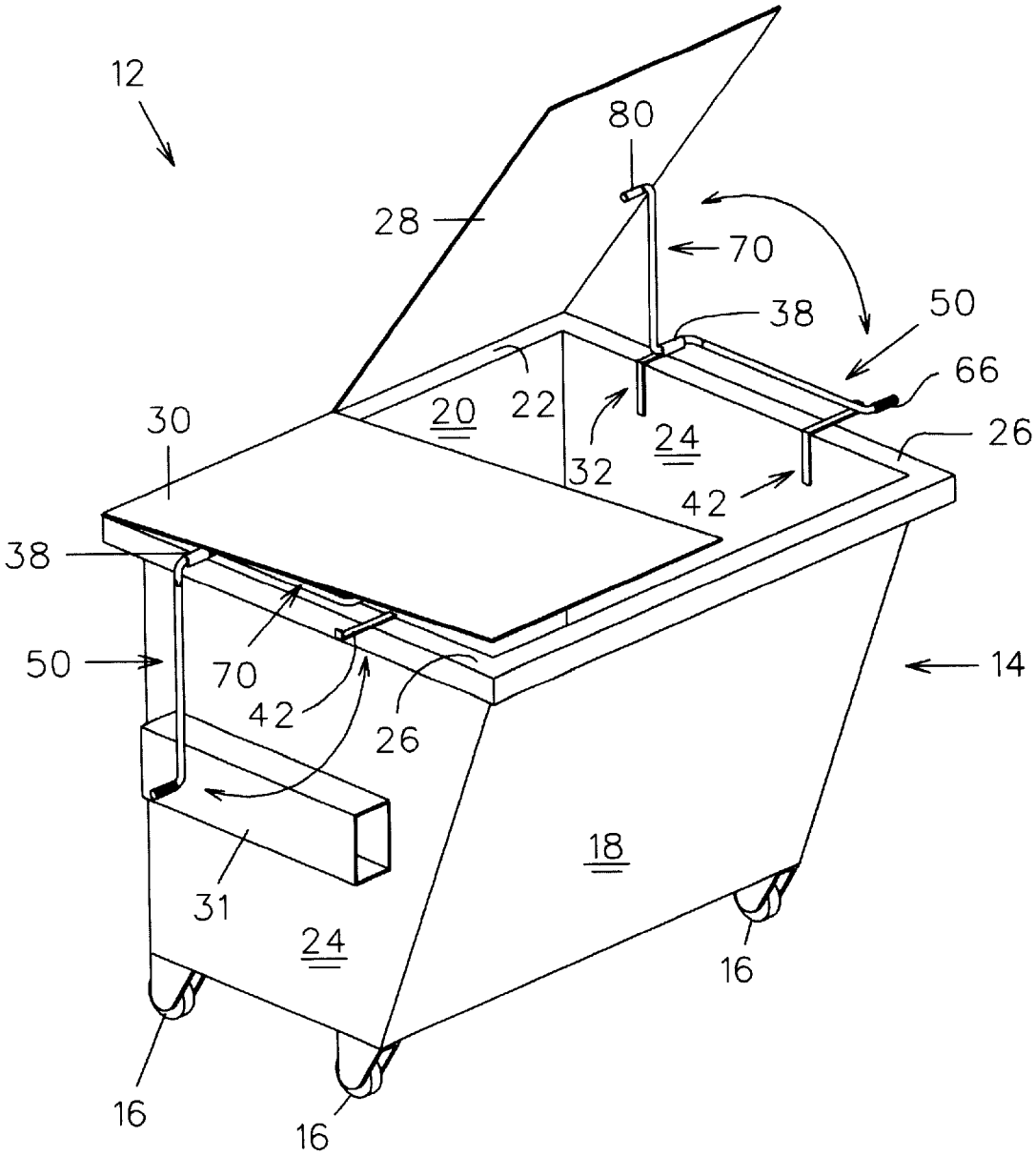
FIG. 1 is a perspective view of the lifting apparatus mounted to a refuse container according to the present invention.
Figure 2:
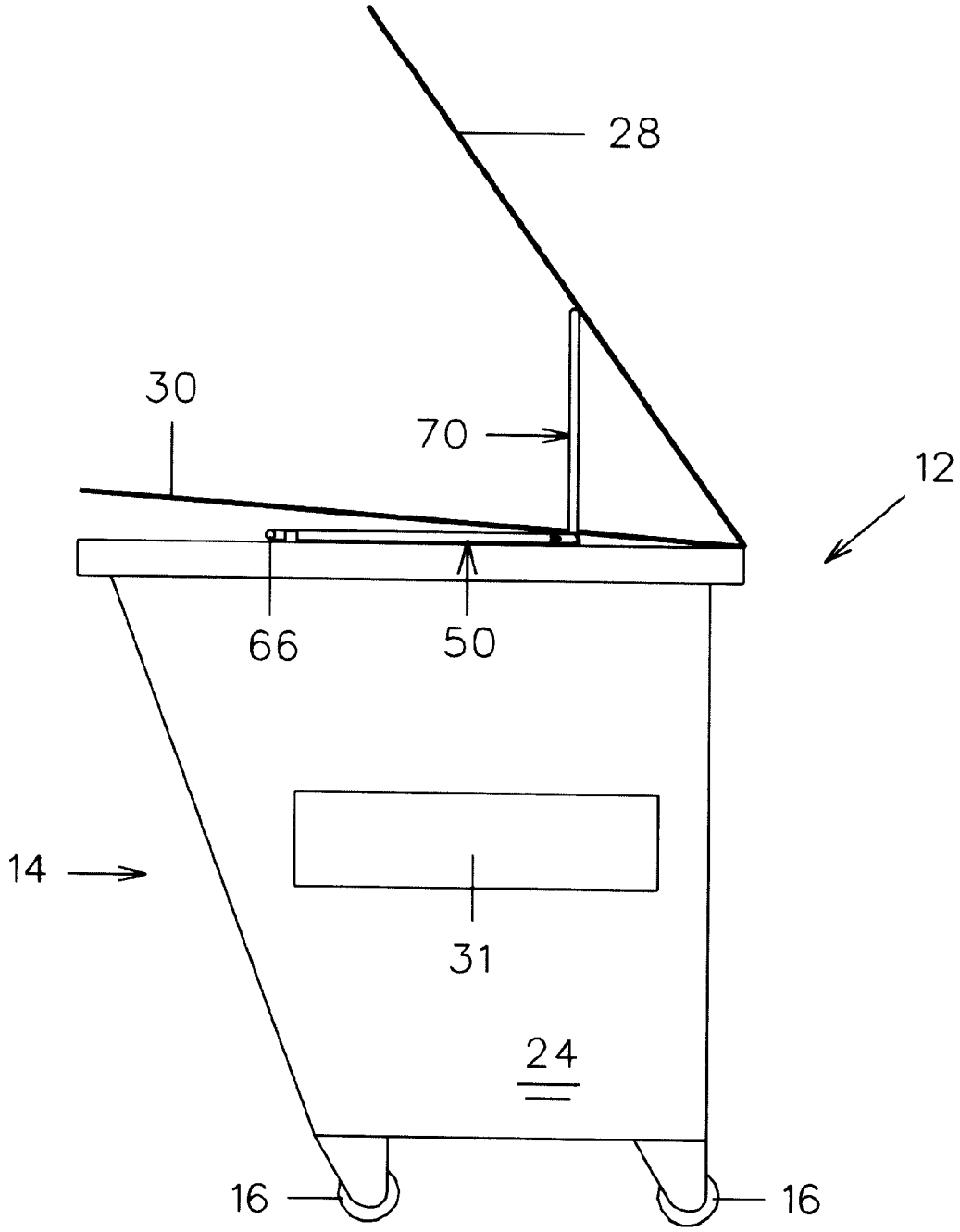
FIG. 2 is a side view of the apparatus as in FIG. 1.

The lifting apparatus 10 according to the invention includes a handle arm 50 and a lifting arm 70 pivotally attached to a front-loading refuse container 12 (FIG. 1). The handle arm 50 and lifting arm 70 are constructed of a sturdy tubular material although solid rods may also be used. The refuse container 12 includes a large generally rectangular bin 14 mounted atop wheel assemblies 16. The bin 14 includes a bottom, front 18 and rear 20 walls, opposing end walls 24, and at least one lid 28 pivotally attached to an upper edge 26 of the rear wall 20. Further, the refuse container 12 includes a lift sleeve 31 fixedly attached to the exterior surface of each end wall 24 such that a refuse truck can lift and dump the contents of the container 12. The refuse container 12 may include a second lid 30 mounted adjacent the first lid 28, the second lid 30 also pivotally coupled to the upper edge 22 of the rear wall 20.

Figure 3:
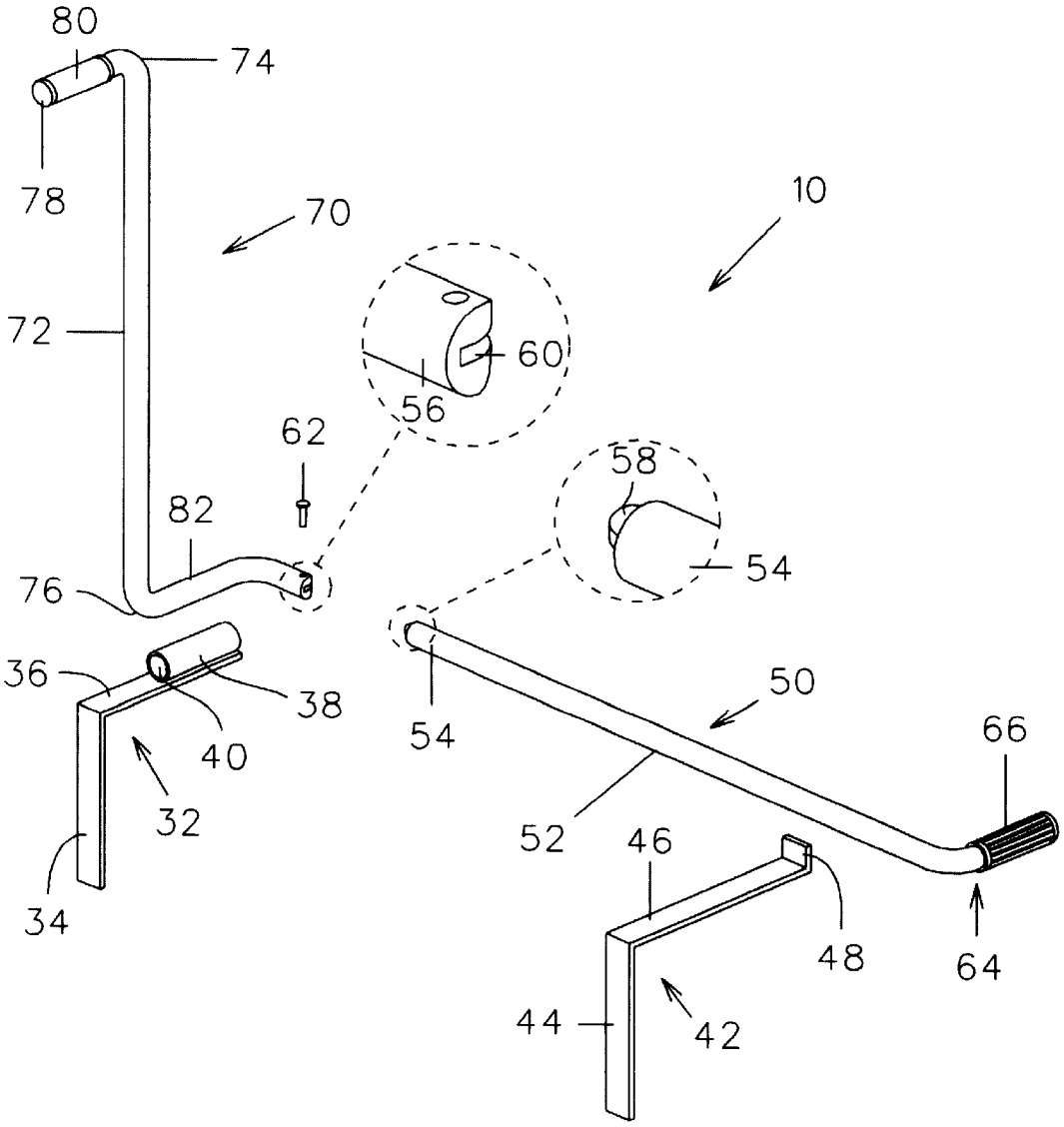
FIG. 3 is an exploded view of the assembly as in FIG. 1 removed from the refuse container.

As shown in FIGS. 1 and 3, the lifting apparatus 10 includes a first mounting bracket 32 having an L-shaped configuration. The first bracket 32 includes a first leg 34 fixedly attached to the interior surface of an end wall 24 of the bin 14. The first bracket 32 further includes a second leg 36 normal to the first leg 34 and extending outwardly from an upper edge 26 of the end wall 24. A cylindrical sleeve 38 having a bore 40 therethrough is fixedly attached to the top of the second leg 36 adjacent a free end thereof. The lifting apparatus 10 further includes a second mounting bracket 42 which presents a configuration substantially similar to that of the first bracket 32, including first 44 and second 46 legs and is mounted to the upper edge 26 of an end wall 24 in like manner. The second bracket 42 is forwardly spaced apart from the first bracket 32. An upstanding flange 48 extends from the free end of the second leg 46.

The handle arm 50 includes an elongate portion 52 and an end portion 64 normal thereto. A handle 66 is pivotally coupled to the free end of the end portion 64 and rotates freely thereabout such that a user need not repeatedly regrip the handle 66 upon pivotal movement of the handle arm 50, as to be described more fully below.

The lifting arm 70 includes an elongate portion 72 having first 74 and second 76 ends. An end portion 78 is normal to the first end 74 of the elongate portion 72 and includes a roller 80 pivotally coupled thereabout for rolling along a bottom surface of the lid 28, as to be more fully described below. A connecting portion 82 is normal to the elongate portion 72 at the second end 76 thereof. The connecting portion 82 presents a diameter smaller than a diameter of the bore 40 of the sleeve 38 and extends therethrough, thus establishing a pivot axis. The connecting portion 82 is fixedly attached to the elongate portion 52 of the handle arm 50. It should be appreciated that the handle arm 50 and lifting arm 70 may be constructed as a single, integrally formed rod.

The elongate portion 52 of the handle arm 50 includes a first portion 54 pivotally coupled to a second portion 56 with a hinge assembly (FIG. 3). The hinge assembly includes a rounded horizontal flange 58 extending from an end of the first portion 54 which mates with a complementary slot 60 in the end of the second portion 56. The flange 58 is pivotally coupled with the slot 60 with a pin 62 which extends transversely through the second portion 56 and flange 58.

The connecting portion 82 of the lifting arm 70 causes the elongate portion 72 of the lifting arm 70 to be offset from the elongate portion 52 of the handle arm 50 and perpendicular thereto. It should also be observed that the connection portion 82 and lifting arm end portion 78 extend in opposing directions (FIG. 3).

Figure 5:
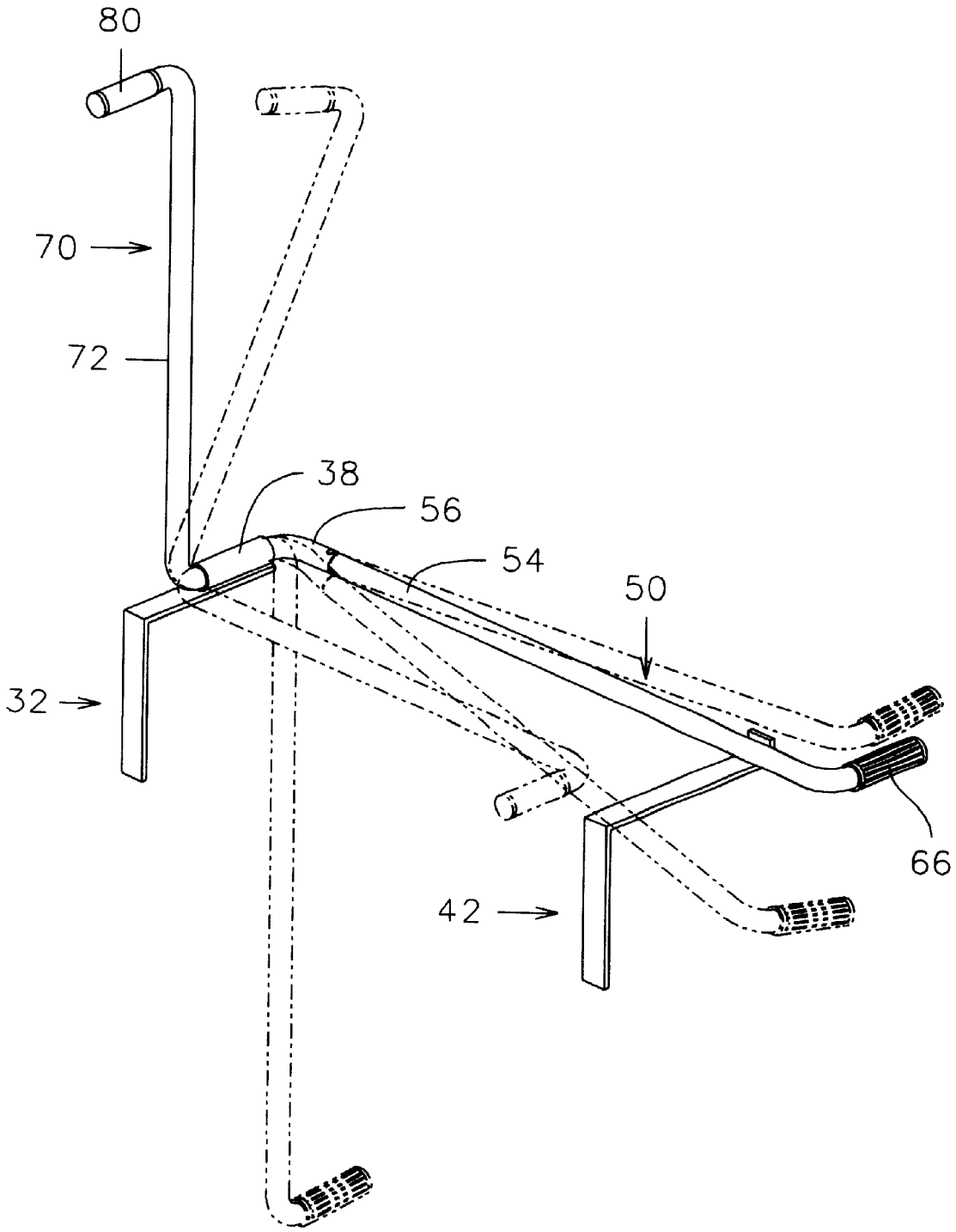
FIG. 5 is a perspective view of the lifting apparatus showing the relative movement thereof.

In operation, the handle arm 50 normally extends downwardly from the upper edge 26 of an end wall 24 when a lid 30 of the refuse container 12 is in a closed position (FIG. 1). In this configuration, the lifting arm 70 is horizontally positioned beneath the lid 30 such that the free end portion 78 is generally adjacent the second bracket 42. As a user grips the handle 66 and pulls the handle arm 50 forward, the lifting arm 70 pivots within the sleeve 38 such that the free end portion 78 is raised (FIG. 5). The handle 66 freely rotates about the end portion 64 such that the user need not regrip the handle 66. When the handle arm 50 is adjacent the second bracket 42, the first portion 54 thereof may be pivoted outwardly to avoid contact therewith. When the handle arm 50 is raised above the second bracket 42, the first portion 54 may be pivoted inwardly and supported atop the second bracket 42. The flange 48 precludes the handle arm 50 from sliding off the second bracket 42. As the lifting arm 70 is pivotally raised, the roller 80 rolls rearwardly across the bottom surface of the lid 28 to a fully raised vertical position. The lid 28 is held open so long as the handle arm 50 is supported atop the second bracket 42. The lid 28 is closed in like manner by first pivoting the first portion 54 of the handle arm 50 outwardly beyond the flange 48 and then pivoting the entire handle arm 50 to its lowermost position. It should be appreciated that the configuration of the lifting apparatus 10 provides sufficient leverage to a user such that the heavy lid of a large refuse container is easy to manipulate.

Figure 4:
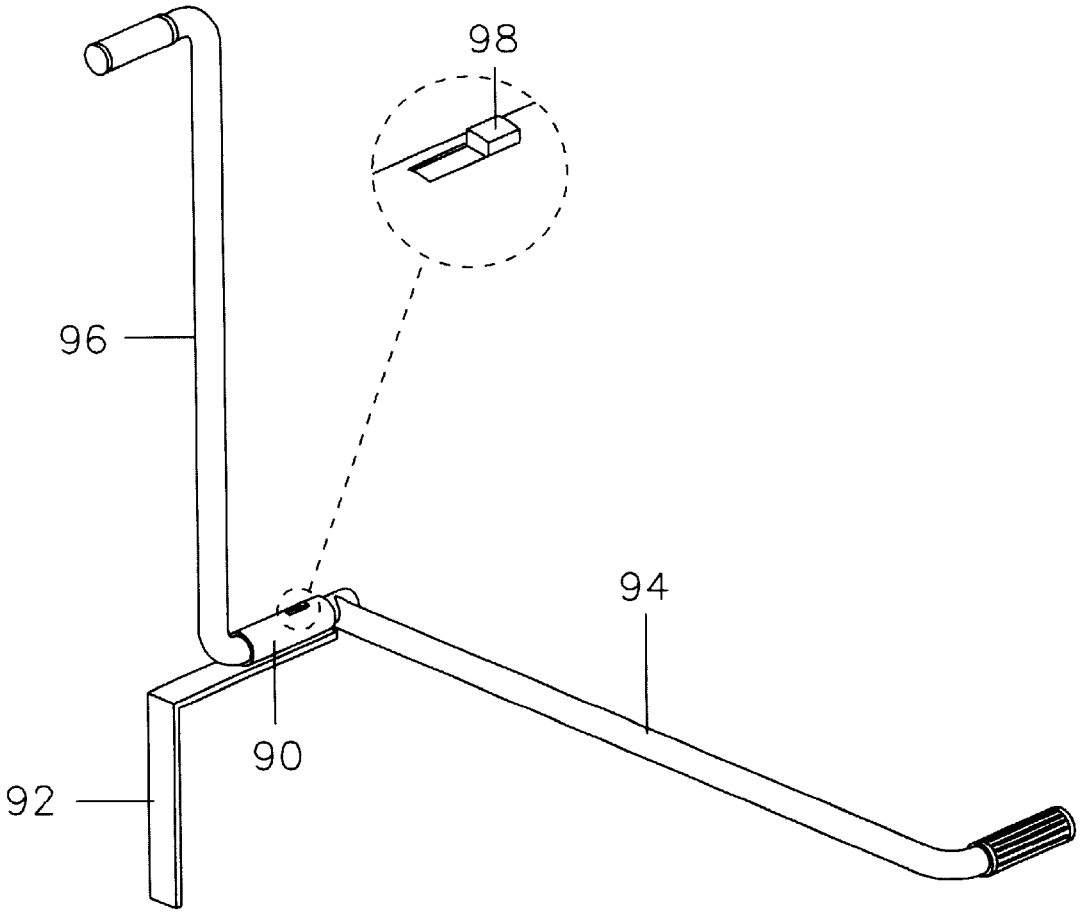
FIG. 4 is a perspective view of an alternative embodiment of the lifting apparatus with an enlarged isolated view of a ratchet assembly switching means.

An alternative embodiment of the lifting apparatus is shown in FIG. 4 having a construction substantially similar to that described above except as specifically noted below. The alternative embodiment of the lifting apparatus includes a ratchet assembly 90 fixedly attached to a mounting bracket 92. One end of a lifting arm 96 is coupled to one end of the ratchet assembly 90 and one end of a handle arm 94 is coupled to an opposing end of the ratchet assembly 90. Having a construction substantially similar to that known in the art, the ratchet assembly 90 includes a pawl which engages a ratchet gear when a user stops operating the handle arm 94. Thus, the pawl acts as a stop to prevent the gear from turning in the opposite direction and thus holds the lifting arm 96 at a selected position. The ratchet assembly 90 also includes a direction selection switch 98 as is known in the art. Accordingly, the lifting arm 96 is incrementally raised or lowered upon repeated operations of the handle arm 94.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A lifting apparatus for use with a refuse bin having a generally rectangular body with a first lid pivotally attached to an upper edge of the body and pivotally movable between open and closed positions, comprising:

a handle arm having first and second ends, said first end terminating in a handle;

a lifting arm having a first end coupled to said second end of said handle arm and a second free end adapted to contact a bottom surface of said first lid; and means for pivotally coupling said lifting arm to said refuse bin whereby an operation of said handle arm rotates said second end of said lifting arm between a first horizontal position adjacent a forward edge of said first lid and a second vertical position rearward of said forward edge.

2. A lifting apparatus as in claim 1 wherein said coupling means comprises:

a first bracket adapted to be attached to an end wall of the refuse bin and configured to extend outwardly from an upper edge thereof; and a sleeve mounted to said first bracket adjacent a free end thereof and having a bore therethrough, said first end of said lifting arm having a diameter slightly smaller than a diameter of said bore such that said lifting arm extends through said bore and pivots therein.

3. A lifting apparatus as in claim 1 wherein said handle is pivotally coupled to said first end of said handle arm for precluding the need of a user to repeatedly regrip said handle during an operation of said handle arm.

4. A lifting apparatus as in claim 1 further comprising a roller mounted to said second free end of said lifting arm such that said second end moves efficiently between said first and second positions in contact with said bottom surface of said first lid.

5. A lifting apparatus as in claim 1 wherein said refuse bin includes a second lid pivotally attached to said upper edge of said body adjacent said first lid.

6. A lifting apparatus as in claim 1 further comprising:

a second bracket adapted to be attached to said end wall adjacent said first bracket and having an arm extending outwardly from said end wall;

a retaining flange extending vertically from a free end of said extended arm; and said handle arm comprising a first portion and a second portion, said first portion pivotally coupled to said second portion whereby said first portion is pivotally displaced from said second bracket during an operation of said handle arm for moving said lifting arm between said first and second positions, said first portion resting atop said extended arm when said lifting arm is in said second position.

7. A lifting apparatus for use with a refuse bin having at least one lid pivotally attached to an upper edge of a rear wall and pivotally movable between open and closed positions, comprising:

a first bracket adopted to be attached to an upper edge of an end wall of said refuse bin, said first bracket including a sleeve;

a first lifting assembly, comprising:

a handle arm having first and second ends, said first end terminating in a handle;

a lifting arm having a first end coupled to said second end of said handle arm and a second free end adapted to bear against a bottom surface of said lid, said lifting arm extending through said sleeve and defining a pivot axis therethrough, said lifting arm having a central portion offset from said handle arm and extending generally perpendicular thereto;

wherein an operation of said handle arm pivotally moves said second free end of said lifting arm between a first horizontal position and a second position vertically displaced from said first position.

8. A lifting apparatus as in claim 7 wherein said sleeve includes a bore therethrough, said first end of said lifting arm having a diameter slightly smaller than a diameter of said bore such that said lifting arm extends through said bore and pivots therein upon an operation of said handle arm.

9. A lifting apparatus as in claim 7 wherein said handle is pivotally coupled to said first end of said handle arm for precluding the need of a user to repeatedly regrip said handle during an operation of said handle arm.

10. A lifting apparatus as in claim 7 further comprising a roller mounted to said second end of said lifting arm such that said second end moves efficiently between said first and second positions in contact with said bottom surface of said lid.

11. A lifting apparatus as in claim 7 further comprising a second lifting assembly which is substantially identical to said first lifting assembly for moving a second lid of the refuse bin between open and closed positions.

12. A lifting apparatus as in claim 7 further comprising:

a second bracket adapted to be attached to said end wall adjacent said first bracket and having an arm extending outwardly from said end wall;

a retaining flange extending vertically from a free end of said extended arm; and said handle arm comprising a first portion and a second portion, said first portion pivotally coupled to said second portion whereby said first portion is pivotally displaced from said second bracket during an operation of said handle arm for moving said lifting arm between said first and second positions, said first portion resting atop said extended arm when said lifting arm is in said second position.

13. A lifting apparatus as in claim 7 further comprising:

a third bracket attached to another end wall of the refuse bin, said third bracket including a second sleeve;

a second lifting assembly, comprising:

a second handle arm having first and second ends, said first end terminating in a handle;

a second lifting arm having a first end coupled to said second end of said second handle arm and a second free end adapted to bear against a bottom surface of said lid, said second lifting arm extending through said second sleeve and defining a pivot axis therethrough, said second lifting arm having a central portion offset from said second handle arm and extending generally perpendicular thereto;

wherein an operation of said second handle arm pivotally moves said second free end of said second lifting arm between a first horizontal position and a second position vertically displaced from said first position.

14. A lifting apparatus for use with a refuse bin having at least one lid pivotally attached to an upper edge of a rear wall and pivotally movable between open and closed positions, comprising:

a ratchet assembly adapted to be attached to an upper edge of an end wall of said refuse bin;

a handle arm having a first end terminating in a handle and a second end adapted to engage said ratchet assembly;

a lifting arm having a first end pivotally coupled to said ratchet assembly and a second end adapted to contact a bottom surface of said lid, whereby an operation of said handle arm causes said lifting arm to incrementally raise or lower said second end of said lifting arm in contact with said lid bottom surface.

15. A lifting apparatus as in claim 14 wherein said handle is pivotally coupled to said first end of said handle arm for precluding the need of a user to repeatedly regrip said handle during an operation of said handle arm.

16. A lifting apparatus as in claim 14 further comprising a roller mounted to said second free end of said lifting arm such that said second end moves efficiently between said first and second positions in contact with said bottom surface of said lid.

17. A lifting apparatus as in claim 14 further comprising a second lifting assembly which is substantially identical to said first lifting assembly for moving a second lid of the refuse bin between open and closed positions.

18. A lifting apparatus as in claim 14 wherein said ratchet assembly includes means for selectively switching the direction of movement imparted to said lifting arm upon an operation of said handle arm.

19. A lifting apparatus as in claim 14 further comprising:

a second ratchet assembly adapted to be attached to an upper edge of another end wall of said refuse bin;

a second handle arm having a first end terminating in a second handle and a second end adapted to engage said second ratchet assembly;

a second lifting arm having a first end pivotally coupled to said second ratchet assembly and a second end adapted to contact a bottom surface of a second lid of said refuse bin, whereby an operation of said second handle arm causes said second lifting arm to incrementally raise or lower said second lifting arm in contact with said lid bottom surface of said second lid.

* * * * *